US011845631B2

(12) United States Patent
Liu et al.

(10) Patent No.: US 11,845,631 B2
(45) Date of Patent: Dec. 19, 2023

(54) SYNCHRONIZING ASSEMBLY FOR ELEVATOR DOOR AND ELEVATOR

(71) Applicant: Otis Elevator Company, Farmington, CT (US)

(72) Inventors: Zhiren Liu, Shanghai (CN); Meihong Mao, Shanghai (CN); Yunbin Cai, Shanghai (CN); JinKoo Lee, Shanghai (CN); Michael Joseph Tracey, Cromwell, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 569 days.

(21) Appl. No.: 17/091,872

(22) Filed: Nov. 6, 2020

(65) Prior Publication Data

US 2021/0139285 A1 May 13, 2021

(30) Foreign Application Priority Data

Nov. 8, 2019 (CN) ..... 201911088321.0

(51) Int. Cl.
*B66B 13/12* (2006.01)
*B66B 13/10* (2006.01)

(52) U.S. Cl.
CPC ..... *B66B 13/12* (2013.01); *B66B 13/10* (2013.01)

(58) Field of Classification Search
CPC ..... B66B 13/12; B66B 13/10; B66B 13/08; B66B 5/00; B66B 13/14
See application file for complete search history.

(56) References Cited

U.S. PATENT DOCUMENTS

2020/0039794 A1* 2/2020 Kim ..... B66B 13/08
2020/0055705 A1* 2/2020 Tracey ..... B66B 13/12
2020/0122978 A1* 4/2020 Tracey ..... B66B 13/12

* cited by examiner

*Primary Examiner* — Jeffrey Donels
(74) *Attorney, Agent, or Firm* — CANTOR COLBURN LLP

(57) ABSTRACT

A synchronizing assembly for elevator door configured to synchronously open and close a first door and a second door from the center of an elevator in responsive to the movement of a belt in a first direction and a second direction. The synchronizing assembly includes a first link extending from a first end to a second end and configured to pivot about a first pivot between the first end and the second end, the first pivot being mounted on the first door, the first end of the first link being pivotally attached to the belt; a second link pivoting about a second pivot mounted on the first door and configured to fix the first link when the second pivot is engaging with the second end of the first link; and a force applying member configured to provide the first link with a force.

18 Claims, 4 Drawing Sheets

SYNCHRONIZING ASSEMBLY FOR ELEVATOR DOOR AND ELEVATOR

FOREIGN PRIORITY

This application claims priority to Chinese Patent Application No. 201911088321.0, filed Nov. 8, 2019, and all the benefits accruing therefrom under 35 U.S.C. § 119, the contents of which in its entirety are herein incorporated by reference.

TECHNICAL FIELD OF INVENTION

The present application relates to the field of elevator door configuration. More specifically, the present application relates to a synchronizing assembly for elevator door that is intended to facilitate smooth and synchronous opening of the elevator door. The present application also relates to an elevator comprising the synchronizing assembly as described above.

BACKGROUND OF THE INVENTION

It is known that an elevator door is provided in an elevator car or an elevator room, and the elevator door may comprise, for example, at least two half doors, and each of the half doors is driven synchronously by a belt. Therefore, the elevator door is provided with a synchronizing mechanism driven by a belt to achieve the effect of being opened and closed from the center.

However, the synchronizing mechanism of the elevator door may generate certain degree of deviation during operation. For example, the opening of the elevator door may be out of sync or produce undesired movements. The above deviations may undermine user experience and bring potential dangers.

Therefore, there is a continuing need for new synchronizing assemblies and elevator solutions, and it is expected that the new solutions will alleviate the above-mentioned problems at least to some extent.

SUMMARY OF THE INVENTION

It is an object of one aspect of the present application to provide a synchronizing assembly for elevator door, and the synchronizing assembly is intended to provide improved stability, so that the elevator door can be opened in a stable and synchronous manner. The object of another aspect of the present application is to provide an elevator that comprises the synchronizing assembly as described above.

The objects of the present application are achieved by the following technical solutions:

A synchronizing assembly for elevator door configured to synchronously open and close a first door and a second door from the center of an elevator in responsive to the movement of a belt in a first direction and a second direction, comprising: a first link extending from a first end to a second end and configured to pivot about a first pivot between the first end and the second end, the first pivot being mounted on the first door, wherein the first end of the first link is pivotally attached to the belt, and the first link pivots in a first pivoting direction when the belt moves in the first direction, and the first link pivots in a second pivoting direction when the band moves in the second direction; a second link pivoting about a second pivot mounted on the first door and the second link being configured to fix the first link when the second link is engaging with the second end of the first link; and a force applying member configured to provide the first link with a force that causes the first link to tend to pivot in the first pivoting direction.

In the aforementioned synchronizing assembly, optionally, the first door remains stationary when the first link is pivoting.

In the aforementioned synchronizing assembly, optionally, it further comprises at least a first stopper and a second stopper, the first stopper and the second stopper being disposed at either sides of the first link, respectively, wherein the first stopper limits pivoting of the first link in the first pivoting direction, and the second stopper limits pivoting of the first link in the second pivoting direction.

In the aforementioned synchronizing assembly, optionally, the first door and the second door are opened with the belt when the first link rests against the first stopper, and the first door and the second door are closed with the belt when the first link rests against the second stopper.

In the aforementioned synchronizing assembly, optionally, the first stopper and the second stopper are configured to be adjustable in position, so as to change the pivoting range of the first link.

In the aforementioned synchronizing assembly, optionally, the first stopper, the second stopper, the first pivot and the second pivot are attached to a panel, and the panel is mounted on the first door.

In the aforementioned synchronizing assembly, optionally, the force applying member comprises a resilient member, one end of the resilient member being attached to the first link and the other end being fixed in relative to the first door.

In the aforementioned synchronizing assembly, optionally, the resilient member comprises a spring or a snap spring.

In the aforementioned synchronizing assembly, optionally, the second link extends from a first end to a second end, and the second pivot is disposed between the first end and the second end of the second link.

In the aforementioned synchronizing assembly, optionally, the second link comprises a hook portion disposed at the second end, the hook portion being configured to latch the first link when engaging with the second end of the first link.

In the aforementioned synchronizing assembly, optionally, it further comprises a first biasing member mounted at the second pivot of the second link, and configured to cause the second link to tend to pivot in the second pivoting direction.

In the aforementioned synchronizing assembly, optionally, the first biasing member comprises a torsion spring.

In the aforementioned synchronizing assembly, optionally, it further comprises a second biasing member selectively contacting the first end of the second link and providing a biasing force in the first direction for the second link.

In the aforementioned synchronizing assembly, optionally, the second biasing member comprises a spring loaded boss.

In the aforementioned synchronizing assembly, optionally, the belt is configured to be driven by a motor, and the horizontal component of the force exerted by the force applying member on the belt through the first link is smaller than the difference between the maximum traction force of the motor and the closing force exerted by the second door on the belt.

In the aforementioned synchronizing assembly, optionally, the horizontal component of the force exerted by the force applying member on the belt through the first link is greater than the sum of the horizontal component of the contact force between the second link and the second biasing member plus a predetermined safety margin.

In the aforementioned synchronizing assembly, optionally, the first end of the first link is pivotally attached to the belt by a belt connector.

An elevator that comprises the aforementioned synchronizing assembly.

The synchronizing assembly for elevator door and the elevator of the present application obtain the advantage of simple in structure, easy to manufacture and convenient to use, etc., and can improve the running stability and the user experience of the elevator.

BRIEF DESCRIPTION OF THE DRAWINGS

The present application will be further described in detail below with reference to the accompanying drawings and preferred embodiments. However, those skilled in the art will understand that the drawings are only for the purpose of explaining the preferred embodiments, and therefore should not be construed as limiting the scope of the present application. In addition, unless otherwise specified, the drawings are only intended to illustratively represent the composition or configuration of the described objects and may comprise exaggerated representations, and the drawings are not necessarily drawn in scale.

DETAILED DESCRIPTION OF THE INVENTION

Figure 1:
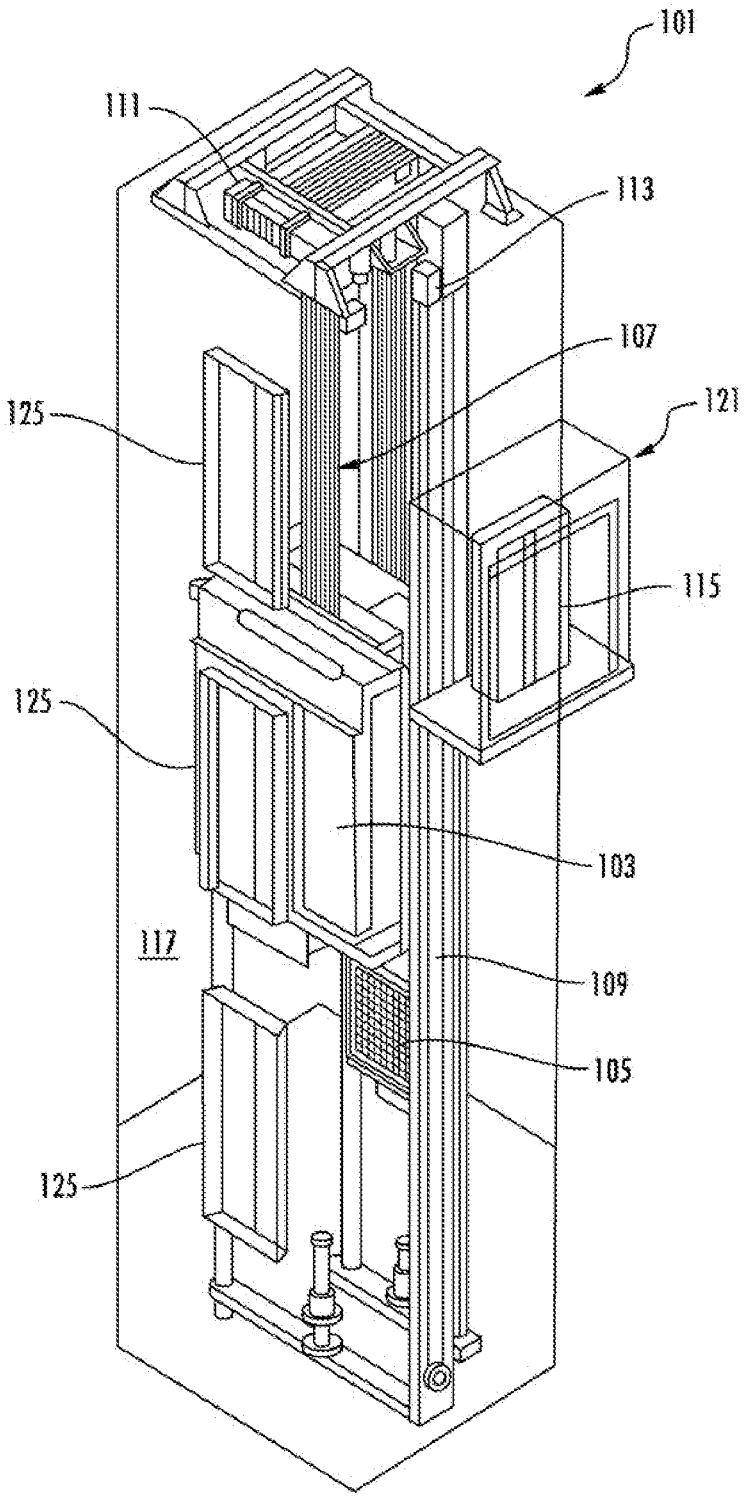
FIG. 1 is a schematic illustration of the structure of an elevator.

Preferred embodiments of the present application will be described in detail below with reference to the accompanying drawings. Those skilled in the art will understand that the descriptions are only illustrative, exemplary, and should not be construed as limiting the scope of the present application.

First, it should be noted that the orientation terms such as top, bottom, upward, downward, and the like mentioned herein are defined with respect to the directions in the respective drawings. They are relative concepts, and thus can vary according to their different locations and different practical states. Therefore, these other orientation terms should not be construed as restrictive terms.

In addition, it should be noted that for any single technical feature described or implied in the embodiments herein, or any single technical feature shown or implied in the drawings, these technical features (or the equivalent thereof) may continue to be combined, so as to obtain other embodiments of the present application that are not directly mentioned in the context.

It should be noted that in the different drawings, the like reference numerals refer to the like or substantially the like components.

FIG. 1 is a schematic view of the structure of an elevator. An elevator system 101 comprises a series of parts mounted within a hoistway 117. The hoistway 117 may be disposed across a plurality of floors 125, and elevator doors are provided at each of the floors 125, respectively. The elevator system 101 comprises a car 103, a counterweight 105, a pulling wire 107, a guide rail 109, a driver 111, a position detecting system 113, a controller 115, and the like. One end of the pulling wire 107 is attached to the car 103, and the other end of the pulling wire 107 is attached to the weight 105. The counterweight 105 is used for balancing the weight of the car 103, and the pulling line 107 is actuated by the driver 111, so as to selectively change the position of the car 103 and park the car 103 at a desired floor. The pulling wire 107 can be, for example, a rope, a steel cable, a coated steel strip, or the like. The pulling wire 107 may also comprise a pulley mechanism or pulley block (not shown) to achieve the desired lifting and lowering operations. It is readily understood that the car 103 is also provided with doors accordingly so as to allow people to enter and exit the car 103.

The driver 111 is disposed at the top of the hoistway 117 and is configured to adjust the positions of the car 103 and the counterweight 105. The driver 111 can be any suitable power supply unit including, but not limited to, an electric motor, or the like. The driver 111 can be powered by a power cord or a power grid (not shown).

The position detecting system 113 can be fixed in relative to the hoistway 117 and is preferably disposed at the top of the hoistway 117, such as on a bracket or rail. The position detecting system 113 is also configured to sense the position of the car 103 within the hoistway 117, so as to provide a position signal related to the position of the car 103. In another embodiment, the position detecting system 113 may also be disposed on other portions, such as on a moving component. The position detecting system 113 may comprise an encoder, a sensor, or other suitable sensing system, and the sensing methods comprise, but are not limited to, speed sensing, relative position sensing, absolute position sensing, digital code sensing, and the like.

The controller 115 may be disposed in a separated control room 121 or at other suitable locations. In one embodiment, the controller 115 may also be disposed in a remote location or in the cloud. The controller 115 is configured to control the operations of the entire elevator system 101. For example, the controller 115 may adjust the operations of the driver 111, so as to cause the car 103 and the counterweight 105 to start, accelerate, decelerate, stop, and the like. The controller 115 can perform control operations based on the signal from the position detecting system 113. In one embodiment, the controller 115 is configured to stop the car 103 at one of the various floors 125, and to accelerate or decelerate between the various floors 125.

The embodiment shown in FIG. 1 is only provided for facilitating understanding. It is readily appreciated that the synchronizing assembly for elevator door in accordance with the present application can be used in any suitable elevator system, such as a cordless elevator system including a linear motor. The synchronizing assembly for elevator door in accordance with the present application can be used for various types of doors that are opened from the center, including car doors, floor doors, and the like.

Figure 2:
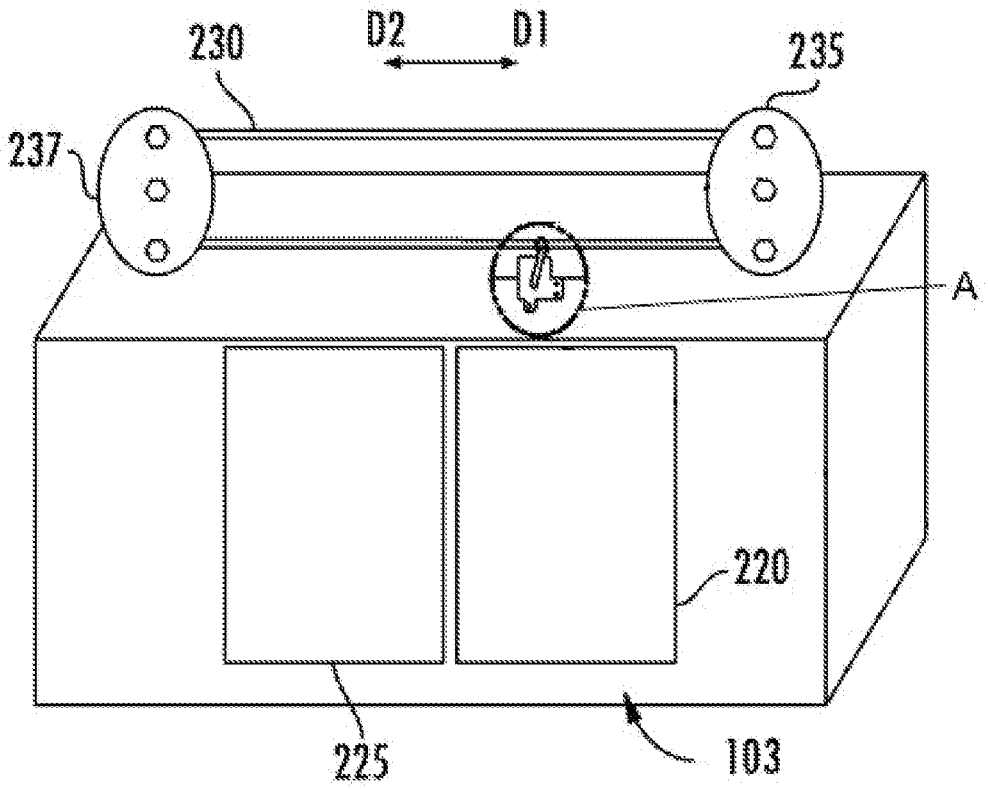
FIG. 2 is a schematic illustration of one embodiment of an elevator door of the present application.

FIG. 2 is a schematic illustration of one embodiment of an elevator door of the present application. In the illustrated embodiment, the car 103 comprises a door system opened from the center that comprises a first door 220 and a second door 225. The first door 220 and the second door 225 are connected to a belt 230 that is driven by a motor or electrical motor 235 and a pulley system 237, shown schematically, so as to move in the direction indicated by arrow D1 or in the direction indicated by arrow D2. As shown in FIG. 2, the first door 220 and the second door 225 are synchronously opened in response to the movement of the belt 230 in the direction indicated by the arrow D1, and synchronously closed in response to the movement of the belt 230 in the direction indicated by the arrow D2.

Figure 3:
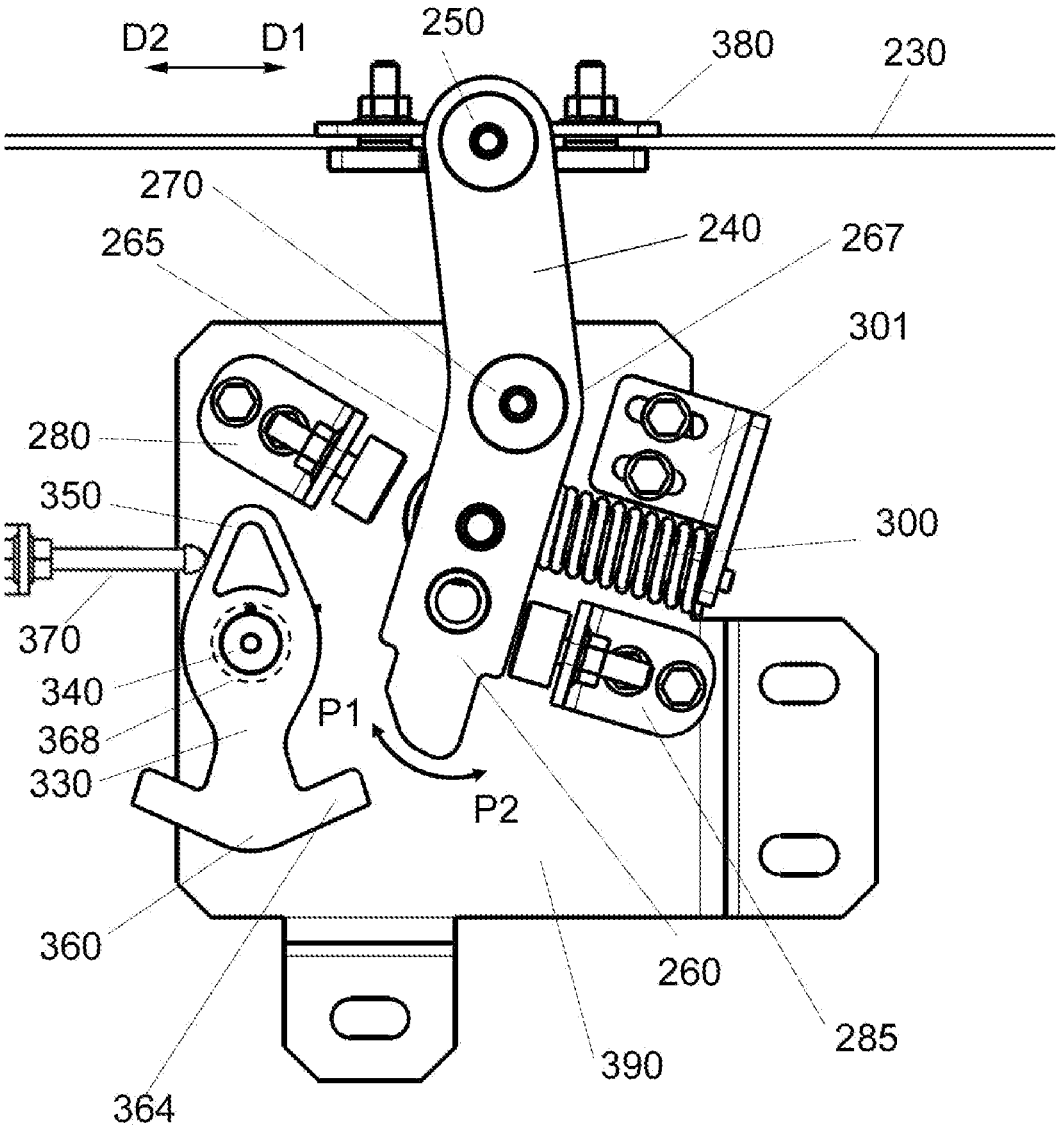
FIG. 3 is an enlarged view of portion A in FIG. 2.
Figure 4:
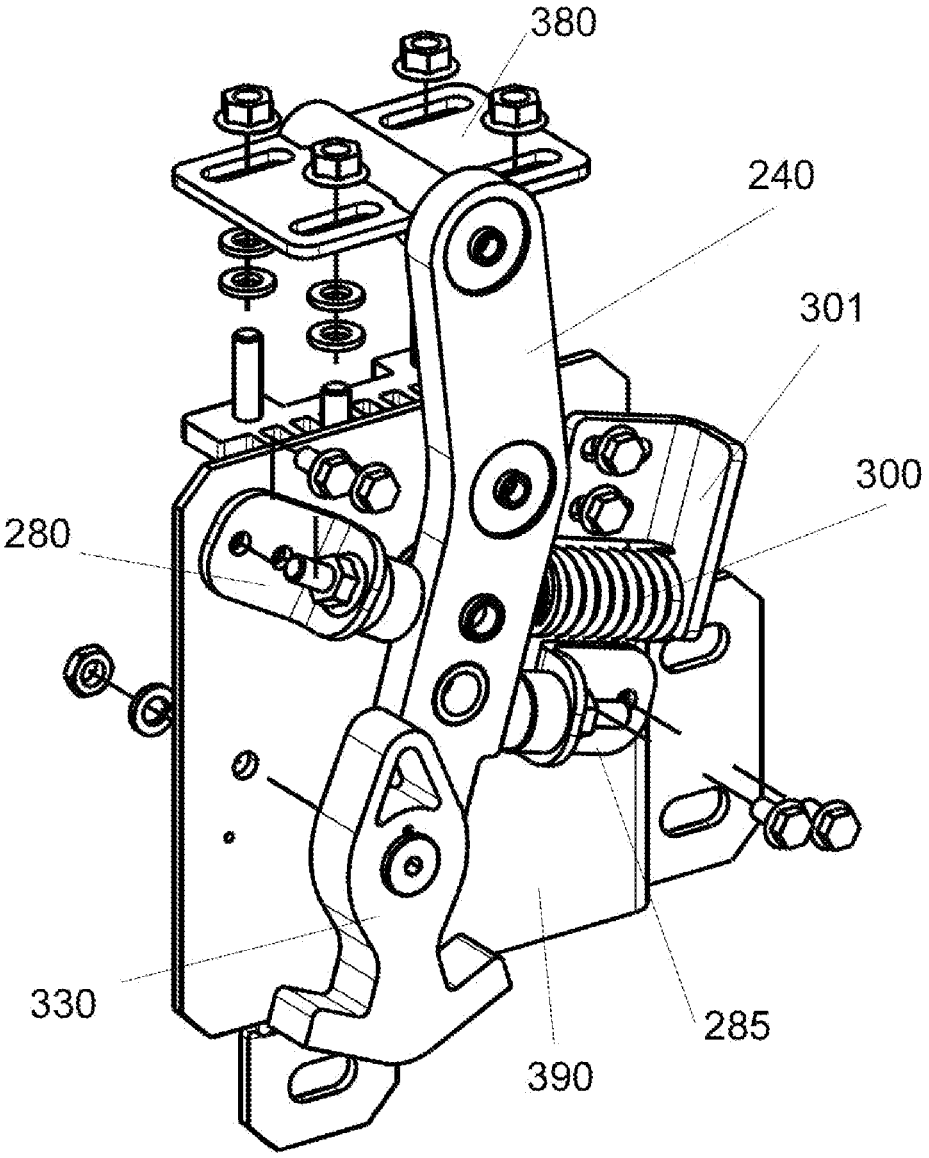
FIG. 4 is an exploded view of a portion of the components in the embodiment shown in FIG. 3.

FIG. 3 is an enlarged view of the portion A of FIG. 2, and FIG. 4 is an exploded view of a portion of the components shown in the embodiment of FIG. 3. In FIG. 3, the first door 220 and other elevator components are not shown for the sake of clarity. FIGS. 3 and 4 collectively illustrate a synchronizing assembly 200 in accordance with one embodiment of the present application. The synchronizing assembly 200 comprises a first link 240, a second link 330, a first stopper 280, a second stopper 285, and a force applying member 300. The various components of the synchronizing assembly 200 can be mounted on a panel 390, and the panel 390 is mounted on one of the first door 220 and the second door 225. For example, the panel 390 can be fixed to the first door 220 (not shown) through the holes shown in FIGS. 3 and 4. In the embodiment shown in FIGS. 2 and 3, the synchronizing assembly 200 is mounted on the first door 220. However, it is readily understood that a synchronizing component in mirror symmetry can also be mounted on the second door 225.

The first link 240 is configured as an elongated structure, and extends from a first end 250 to a second end 260. The first link 240 pivots about a first pivot 270 between the first end 250 and the second end 260. The first pivot 270 can be mounted on the panel 390 and the panel 390 can be mounted on the first door 220. The first end 250 of the first link 240 is pivotally attached to a belt 230. In the illustrated embodiment, the first end 250 of the first link 240 is coupled to the belt 230 through a belt connector 380. The function of the belt connector 380 is to transfer the force from the belt 230 and promote the pivoting movement of the first link 240. It is readily understood that when the belt 230 moves in a first direction D1, the first link 240 pivots about the first pivot 270 in a first pivoting direction P1; when the belt 230 moves in a second direction D2, the first link 240 pivots about the first pivot 270 in a second pivoting direction P2. The second end 260 of the first link 240 can be configured to be tongue-shaped, so as to latch and snap with the second link 330 as described in further detail below. As shown, the second end 260 of the first link 240 may be provided with a through hole, and the distance from the second end 260 of the first link 240 to the first pivot 270 may be greater than the distance from the first end 250 of the first link 240 to the first pivot 270.

The second link 330 pivots about the second pivot 340. The second pivot 340 can be mounted on the panel 390, and the panel 390 can be mounted on the first door 220. The second link 330 is provided with a first end 350 and a second end 360, and the second pivot 340 is disposed between the first end 350 and the second end 360. A second end 360 of the second link 330 is provided with a hook portion 364 that is configured to latch the first link 240 when engaging with the second end 260 of the first link 240. With the hook portion 364 engaging with the second end 260 of the first link 240, the first link 240 is not free to pivot. With the hook portion 364 disengaging from the second end 260 of the first link 240, the first link 240 can pivot within defined positions as described in detail below.

A first biasing member 368 can be mounted at the second pivot 340 of the second link 330, and the first biasing member 368 is configured to force the second link 330 to tend to pivot in the second pivoting direction P2. In one embodiment of the present application, the first biasing member 368 can be, for example, a torsion spring 11.

The portion of the second link 330 that surrounds the second pivot 340 can have an increased size relative to the first end 350 of the second link 330, so as to accommodate the first biasing member 368.

The first stopper 280 and the second stopper 285 are disposed on either side of the first link 240 (i.e., at the first side 265 and the second side 267 in FIG. 3), respectively. The first stopper 280 limits pivoting of the first link 240 in the first pivoting direction P1, and the second stopper 285 limits pivoting of the first link 240 in the second pivoting direction P2. Each stopper can be configured to be detachable, so as to be mounted and adjusted in position according to practical needs. Similarly, each stopper is attached to the first door 220 through a panel 390.

According to other embodiments, more than one stopper may also be provided at either side of the first link 240, and stoppers for the second link 330 may also be provided. A rubber and gasket structure may be disposed at the end of each stopper facing the first link 240, so as to extend the service life of the synchronizing assembly 200.

According to one embodiment of the present application, the first stopper 280 and the second stopper 285 limit the pivoting range for the first link 240. When the first link 240 rests against the first stopper 280, the first door 220 and the second door 225 are synchronously opened from the center by the belt 230, and the belt 230 moves in the first direction D1. When the first link 240 rests against the second stopper 285, the first door 220 and the second door 225 are synchronously closed toward the center by the belt 230, and the belt 230 moves in the second direction D2. Moreover, when the first link 240 pivots about the first pivot 270 between the first stopper 280 and the second stopper 285, the first door 220 is substantially stationary.

The illustrated embodiment further provides a second biasing member 370. The second biasing member 370 can be mounted to be fixed relative to the car 103, such that the first door 220 and the synchronizing assembly 200 can move relative to the second biasing member 370, and the second biasing member 370 selectively contacts the first end 350 of the second link 330. Therefore, the second biasing member 370 can provide the second link 330 with a biasing force in the first direction D1. The second biasing member 370 can be, for example, a spring loaded boss.

One end of the force applying member 300 is attached to the first link 240, and the other end is fixed at a position 301 relative to the panel 390 or the first door 220. The force applying member 300 is configured to provide the first link 240 with a force that causes the first link 240 to tend to pivot in the first pivoting direction P1. The force applying member 300 can be, for example, a resilient member including, but not limited to, a spring, a snap spring, or the like. The force applying member 300 can be attached to the first link 240 or fixed at the position 301, by, for example, bolts or nuts (not shown).

In the illustrated embodiment, the force applying member 300 is disposed at a second side 267 of the first link 240, and the second link 330 is disposed at a first side 265 of the first link 240. The force applying member 300 is attached to the first link 240 between the second end 260 of the first link 240 and the first pivot 270. Therefore, in the illustrated embodiment, the force applying member 300 or the spring is in a pressed state, and thus the elastic thrust in the first pivoting direction P1 can be provided. In another embodiment, the force applying member can be disposed at the first side 265 of the first link 240. At this time, the force applying member can be in a released state, thus providing an elastic pulling force in the first pivoting direction P1.

According to one embodiment of the present application, the force applied by the force applying member 300 may have an upper limit and a lower limit. For example, the belt 230 can be configured to be driven by the motor 235 in FIG. 2, and the second door 225 can be provided with an elevator door switch assembly that mates with the synchronizing assembly 200 in accordance with the present application. The components mounted on the second door 225 are also driven by the same belt 230. Therefore, during the opening and closing of the elevator doors, the components mounted on the second door 225 will exert a reaction force on the belt 230, that is, the door closing force. It is desirable that the force applied by the motor 235 to the belt 230 must be able to overcome the aforementioned door closing force and the force applied by the force applying member 300. In summary, the horizontal component of the force exerted by the force applying member 300 on the belt 230 through the first link 240 is smaller than the difference between the maximum pulling force of the motor 235 and the door closing force applied to the belt 230 by the second door 225. Furthermore, in the door-closed state, the first biasing member 368 on the second link 330 will generate a biasing force that causes the second link 330 to tend to pivot in the second pivoting direction P2. Other components (e.g., springs, etc.) for mounting and supporting the second biasing member 370 also exert a force to the synchronizing assembly 200. Therefore, the contact force between the first biasing member 368 and the second biasing member 370 tend to move the synchronizing assembly 200 toward the door opening direction or the first direction D1, thus generating a door opening force. Thus, in one embodiment of the present application, the horizontal component of the force exerted by the force applying member 300 on the belt 230 through the first link 240 is greater than the sum of the contact force between the second link 330 and the second biasing member 370 plus a predetermined safety margin. In addition, on the second link 330, the contact force between the second link 330 and the second biasing member 370 reaches torque balance with the torque force of the first biasing member 368.

FIG. 4 shows an exploded view of a portion of the components in the embodiment shown in FIG. 3. As shown, the aforementioned various components are attached by bolts, nuts, and the like. The second biasing member 370 and belt 230 are not shown in FIG. 4 for the sake of clarity.

In use, as shown in FIG. 3, when the first door 220 and the second door 225 are in a closed state, the first link 240 rests against the second stopper 285, and the first end 350 of the second link 330 rests against the second biasing member 370. The second biasing member 370 forces the second link 330 to bias from the equilibrium position and into the position shown in FIG. 3. In this position, the first end 350 of the second link 330 is substantially just above the second end 360 of the second link 330. The first biasing member 368 is in pressed state, generating a force that causes the second link 330 to tend to pivot in the second pivoting direction P2. The force generated by the first biasing member 368 is also balanced with the force exerted by the second biasing member 370.

If it is desired to open the door, a force is exerted through the belt 230, so as to drive the belt connector 380 to move in the first direction D1. Therefore, the first link 240 moves in the first pivoting direction P1 around the first pivot 270 under the combined action of the belt connector 380 and the force applying member 300, such that the second side 267 of the first link 240 is separated from the second stopper 285, until the first side 265 of the first link 240 is in contact with the first stopper 280. The entire synchronizing assembly 200 will then move in the first direction D1 under the pulling force from the belt 230, such that the first end 350 of the second link 330 is separated from the second biasing member 370. At this time, the second link 330 will pivot about the second pivot 340 in the second pivoting direction P2 under the force generated by the first biasing member 368, such that the hook portion 364 engages with the second end 260 of the first link 240 and latches the second end 260 of the first link 240 between the hook portion 364 and the first stopper 280. Under this state, the synchronizing assembly 200 and the first door 220 will continue to move in the first direction D1 under the pulling force from the belt 230, until the first door 220 is fully opened. With the help of the force applying member 300, the aforementioned door opening process will be smoothly performed, without causing disturbance or abnormal movement of the components.

It is readily understood that, after the second side 267 of the first link 240 disengages from the second stopper 285 and before the first side 265 of the first link 240 is in contact with the first stopper 280, the first door 220 is stationary.

When the first door 220 and the second door 225 are closed, action is taken in the reverse of the aforementioned operation. If it is desired to close the door, a force is exerted through the belt 230 to drive the belt connector 380 and the synchronizing assembly 200 (and thus the first door 220) to move in the second direction D2. When the first end 350 of the second link 330 moves into contact with the second biasing member 370, the second biasing member 370 exerts a force to the first end 350 of the second link 330, such that the second link 330 overcomes the force of the first biasing member 368 and pivots about the second pivot 240 in the first pivoting direction P1. Accordingly, the hook portion 364 will detach from the second end 260 of the first link 240. Then, the force acting on the belt 230 in the second direction D2 will bring the first link 240 to pivot about the first pivot 270 in the second pivoting direction P2, such that the first side 265 of the first link 240 will disengage from the first stopper 280. The first link 240 will pivot to a position such that its second side 267 is in contact with the second stopper 285. With the help of the force applying member 300, the aforementioned door closing process will be smoothly performed, without causing disturbance or abnormal movement of the components.

It is readily understood that, after the first side 265 of the first link 240 disengages from the first stopper 280 and before the second side 267 of the first link 240 is in contact with the second stopper 285, the first door 220 is stationary. As can be known from the foregoing, when the first link 240 pivots between the first stopper 280 and the second stopper 285, the first door 220 is stationary.

The desired effect can be achieved by performing the aforementioned door opening and closing operations using the synchronizing assembly 200 disclosed above. In particular, by employing the force applying member 300 and designing a suitable applied force for the force applying member 300, undesired disturbances and asynchronization of the first link 240 and the second link 330 in the synchronizing assembly 200 during the door opening and closing processes of the first door 220 and the second door 225 can be eliminated, thereby achieving smooth and synchronous opening and closing of the first door 220 and the second door 225, and effectively improving user experience. Moreover, the synchronizing assembly 200 in accordance with one embodiment of the present application is also capable of reducing undesired disturbances and motions, thereby prolonging the service life, safety, and noise performance of the products.

The present application also relate to an elevator that comprises the synchronizing assembly as mentioned above.

The present specification discloses the present application by reference to the drawings, and enables those skilled in the art to carry out the application, including manufacture and usage of any device or system, selection of suitable materials, and usage of any combined method. The scope of the present application is defined by the claimed technical solutions, and comprises other examples conceivable to those skilled in the art. As long as such other examples comprise structural elements that are not different from the claimed technical solution in literal expression, or such other examples contain equivalent structural elements that are not substantially different from the claimed technical solution in literal expression, then they should be considered as falling within the scope of protection determined by the technical solution claimed in the present application.

What is claimed is:

1. A synchronizing assembly for elevator door configured to synchronously open and close a first door and the second door from the center of an elevator in responsive to the movement of a belt in a first direction and a second direction, characterized in that the synchronizing assembly comprises:

a first link extending from a first end to a second end and configured to pivot about a first pivot between the first end and the second end, the first pivot being mounted on the first door, wherein a first end of the first link is pivotally attached to the belt, and wherein the first link pivots in a first pivoting direction when the belt moves in the first direction, and the first link pivots in a second pivoting direction when the belt moves in the second direction;

a second link pivoting about a second pivot mounted on the first door, the second link configured to engage the second end of the first link; and a force applying member configured to provide the first link with a force that causes the first link to tend to pivot in the first pivoting direction.

2. The synchronizing assembly of claim 1, characterized in that the first door remains stationary when the first link is pivoting.

3. The synchronizing assembly of claim 2, characterized in that it further comprises at least a first stopper and a second stopper, the first stopper and the second stopper being disposed at either sides of the first link, respectively, wherein the first stopper limits pivoting of the first link in the first pivoting direction, and the second stopper limits pivoting of the first link in the second pivoting direction.

4. The synchronizing assembly of claim 3, characterized in that the first door and the second door are opened with the belt when the first link rests against the first stopper, and the first door and the second door are closed with the belt when the first link rests against the second stopper.

5. The synchronizing assembly of claim 3, characterized in that the first stopper and the second stopper are configured to be adjustable in position, so as to change the pivoting range of the first link.

6. The synchronizing assembly of claim 3, characterized in that the first stopper, the second stopper, the first pivot and the second pivot are attached to a panel, and the panel is mounted on the first door.

7. The synchronizing assembly of claim 3, characterized in that the force applying member comprises a resilient member, one end of the resilient member being attached to the first link and the other end being fixed to the first door.

8. The synchronizing assembly of claim 7, characterized in that the resilient member comprises a spring or a snap spring.

9. The synchronizing assembly of claim 3, characterized in that the second link extends from a first end to a second end, and the second pivot is disposed between the first end and the second end of the second link.

10. The synchronizing assembly of claim 9, characterized in that the second link comprises a hook portion disposed at the second end, the hook portion being configured to latch the first link when engaging with the second end of the first link.

11. The synchronizing assembly of claim 9, characterized in that it further comprises a first biasing member mounted at the second pivot of the second link, and configured to cause the second link to tend to pivot in the second pivoting direction.

12. The synchronizing assembly of claim 11, characterized in that the first biasing member comprises a torsion spring.

13. The synchronizing assembly of claim 9, characterized in that it further comprises a second biasing member selectively contacting the first end of the second link and providing the second link with a biasing force in the first direction.

14. The synchronizing assembly of claim 13, characterized in that the second biasing member comprises a spring loaded boss.

15. The synchronizing assembly of claim 9, characterized in that the belt is configured to be driven by a motor, wherein the horizontal component of the force exerted by the force applying member on the belt through the first link is smaller than the difference between the maximum traction force of the motor and the closing force exerted by the second door on the belt.

16. The synchronizing assembly of claim 13, characterized in that the horizontal component of the force exerted by the force applying member on the belt through the first link is greater than the sum of the horizontal component of the contact force between the second link and the second biasing member plus a predetermined safety margin.

17. The synchronizing assembly of claim 1, characterized in that the first end of the first link is pivotally attached to the belt by a belt connector.

18. An elevator characterized in that it comprises the synchronizing assembly according to claim 1.

* * * * *